United States Patent [19]

Heeren et al.

[11] Patent Number: 4,817,690

[45] Date of Patent: Apr. 4, 1989

[54] DEVICE FOR FILLING TRANSPORTABLE VESSELS WITH FLOWABLE MATERIALS

[75] Inventors: Dieter Heeren, Ascheberg; Friedrich Vock, Münster, both of Fed. Rep. of Germany

[73] Assignee: Basf Lacke & Farben AG, Münster, Fed. Rep. of Germany

[21] Appl. No.: 75,814

[22] PCT Filed: Aug. 21, 1986

[86] PCT No.: PCT/EP86/00490

§ 371 Date: May 26, 1987

§ 102(e) Date: May 26, 1987

[87] PCT Pub. No.: WO87/01681

PCT Pub. Date: Mar. 26, 1987

[30] Foreign Application Priority Data

Sep. 23, 1985 [DE] Fed. Rep. of Germany ..... 3533837

[51] Int. Cl.[4] ..... B65B 39/00

[52] U.S. Cl. ..... 141/338; 220/85 F; 220/855 P

[58] Field of Search ..... 141/312, 337, 338, 374, 141/382; 193/25 C; 220/85 F, 85 SP, 86 R, 465

[56] References Cited

U.S. PATENT DOCUMENTS

| | | | |
|---|---|---|---|
| 3,738,464 | 6/1973 | Ortlip et al. | 193/25 C |
| 4,256,154 | 3/1981 | Black | 141/338 X |
| 4,296,502 | 10/1981 | Bortle | 141/337 X |
| 4,589,578 | 5/1986 | Hayward | 220/855 P X |
| 4,632,282 | 12/1986 | Nagashima | 220/855 P X |
| 4,640,313 | 2/1987 | Stanley | 138/97 X |

FOREIGN PATENT DOCUMENTS

| | | |
|---|---|---|
| 2113472 | 6/1972 | France . |
| 2456277 | 12/1980 | France . |
| 2029378 | 3/1980 | United Kingdom . |

*Primary Examiner*—Harvey C. Hornsby
*Assistant Examiner*—K. L. O'Leary
*Attorney, Agent, or Firm*—Kenyon & Kenyon

[57] ABSTRACT

The invention relates to a device for filling transportable vessels with flowable materials in free fall, with a filler socket arranged on the top wall of the vessel, a first clamping ring which can be fastened removably to the filler socket, a second clamping ring which can be attached on the topside of the first clamping ring, and a flexible filler hose fastened at its respective ends to the first clamping ring and to the second clamping ring, the flexible filler hose being folded back inwards on itself in the region of the first clamping ring and having a weighting ring in its reversal region.

9 Claims, 2 Drawing Sheets

Figures 1, 1A:
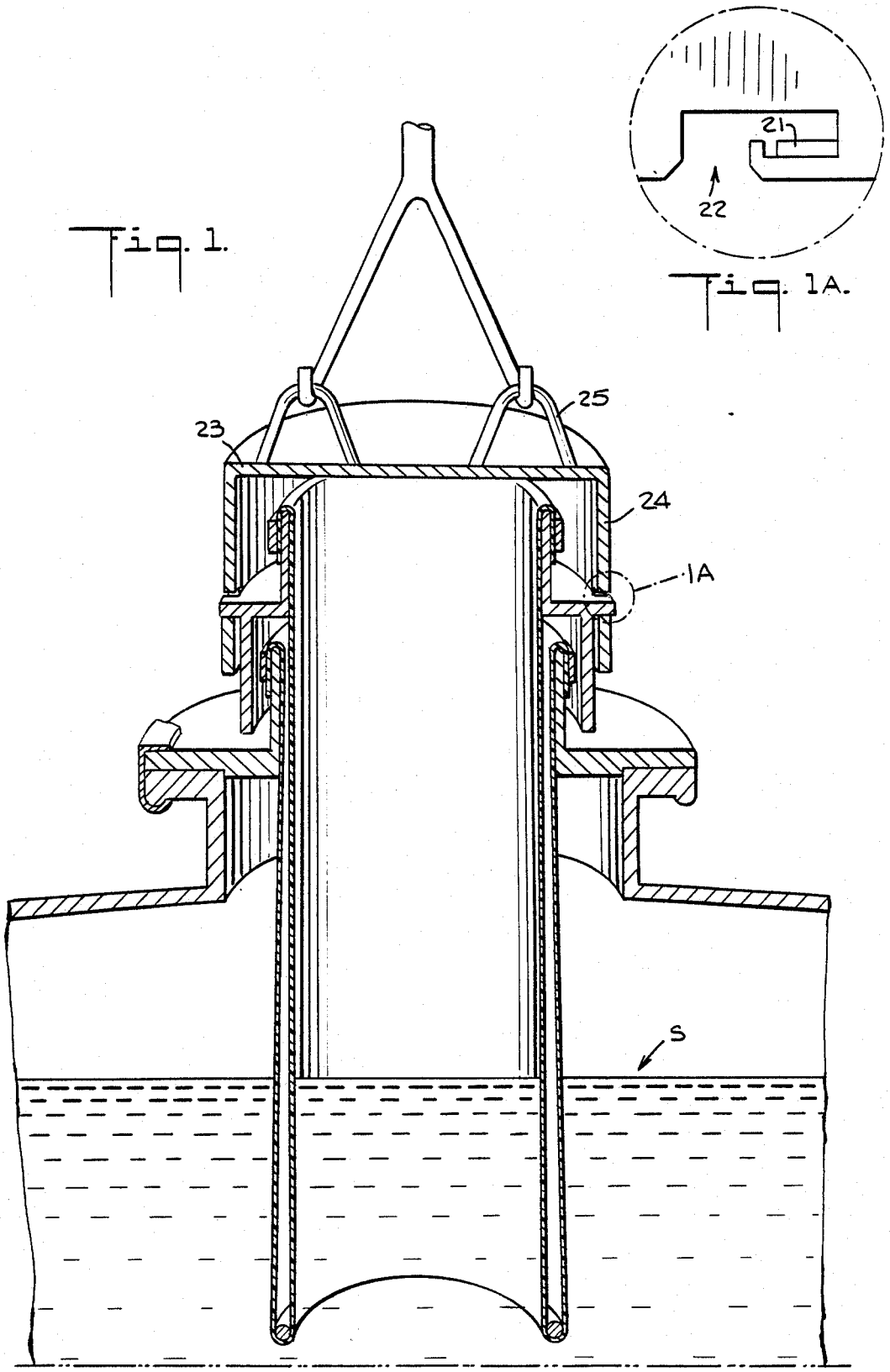

21
22
23
24
25
1A
S

DEVICE FOR FILLING TRANSPORTABLE VESSELS WITH FLOWABLE MATERIALS

The invention relates to a device for filling transportable vessels.

It is necessary to fill vessels with flowable materials in free fall, especially in in-plant systems, in order to make it possible to convey the materials necessary for production quickly from a central storage point to the individual processing stations. It is also necessary to fill transportable vessels in free fall from a supply container in other large transport systems, for example in the agricultural fodder industry. In such systems, it is important to convey the free-falling flowable material through suitable hoses, in order to prevent splashing, the generation of dust and stray emissions. It is difficult, in the known systems, to adjust the height exactly between the discharge point from the supply store and the filler socket of the transportable vessel, and when flexible hoses are used, the outside of the hose must be prevented from coming in contact with the conveyed material, so that it is thereby possible to handle the filler hose and avoid pollution of the environment.

The object on which the invention is based is to provide a connecting system between a transportable vessel and a central filling station, having a flexible filler hose which can be matched vertically and horizontally to the position of the transportable vessel in relation to the discharge point of the supply container, but without the outside of the filler hose ever coming in contact with the filling material.

This object on which the invention is based is achieved by means of a flexible filler hose which is connected to clamping rings at both its ends and which is folded back on itself, a weighting ring being provided in the lower reversal region, thus always guaranteeing a correct downward-directed position of the filler hose, changes in height of the filler hose now being possible without the outside of the filler hose coming in contact with the free ambient air. Furthermore, the extent to which the filler hose penetrates into the transportable vessel is reduced by half, so that when equipment, such as paddles or the like, are arranged in the transportable vessel, the filler hose does not come in contact with these paddle devices.

At the same time, the filler hose can be transported together with the flexible vessel and, for example, its bottom end dips below the level of liquid in the transportable vessel, so that only the liquid located within the cross-section of the filler hose is in breathing contact with the atmosphere outside the vessel. Emissions of combustible liquids are greatly reduced as a result.

Figure 2:
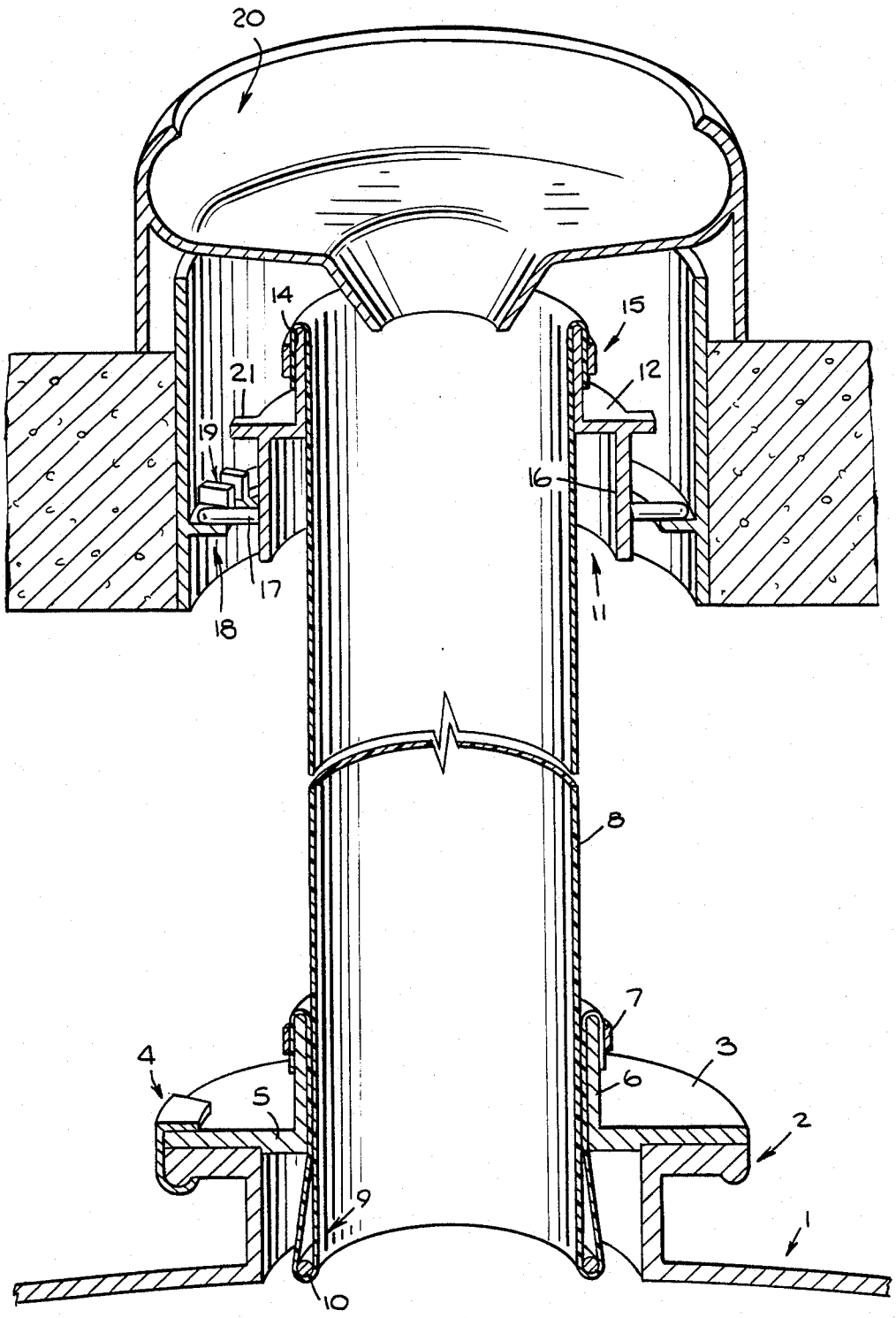

An exemplary embodiment of the invention is explained below with reference to the drawings. In the drawings:

FIG. 1 shows a part view of a transportable vessel with an attached filler hose and a cowl closing the latter, and FIG. 1A shows a magnified cut-out view of FIG. 1 emphasizing holding lugs and corresponding recesses in the cowl, and FIG. 2 shows the filler hose according to FIG. 1, in the extended state and connected to a discharge orifice for the flowable materials to be transported.

In the drawings, 1 denotes a transportable vessel which has a filler socket 2 on its topside. A first clamping ring 3 is connected to this filler socket 2 and fastened, for example, by means of appropriate hook fastenings 4. The first clamping ring 3 consists of an annular disk 5 with a central orifice, to which is adjacent a cylindrical connexion piece 6 directed upwards. Fastened to the outside of the cylindrical connexion piece, with a clip 7 interposed, is the bottom free end of a flexible filler hose 8 which, folded back on itself, is guided upwards so that it forms a reversal region 9 in the lower zone. Arranged in the annular space formed by this reversal region 9 is a weighting ring 10 which preferably consists of a round carrier unit, for example a wire or the like, on which spherical bodies 30 are arranged rotatably, so that, in the event of changes in length of the flexible filler hose 8, this weighting ring 10 can easily follow the movements of the hose.

The opposite top end of the filler hose 8 is fastened to a second clamping ring 11. This second clamping ring 11 consists of an annular disk 12 with an upward-directed cylindrical connexion piece 14, to the outside of which the flexible filler hose 8 is fastened by means of a clip 15. Connected to the underside of the annular disk 12 is a second cylindrical connexion piece 16 which has an inside diameter greater than the outside of the cylindrical connexion piece 14. Moreover, the inside diameter of the cylindrical connexion piece 16 is greater than the outside diameter of the cylindrical connexion piece 6 of the first clamping ring 3. This makes it possible to fit the second clamping ring 11 onto the first clamping ring 3.

Support bearings 17 are arranged on the outside of the second cylindrical connexion piece 16, and the part view in FIG. 2 shows that as a result of an appropriate design of the wall of the discharge orifice of the actual supply container, this discharge orifice being designated as a whole by 18 in FIG. 2, it is possible to place these support bearings 17 on corresponding support blocks 19. As a result, the second clamping ring 11 can be secured in the region of the discharge orifice 18, and the connexion between the filling funnel 20 shown in FIG. 2 and the actual filler socket 2 of the vessel 1 is now made by means of the flexible filler hose 8.

The annular disk 12 has holding lugs 21 which project beyond the outer periphery of the second cylindrical connexion piece 16 and which, as shown in the cut-out view of FIG. 1, can be inserted into corresponding recesses 22 in a cowl 23, as a result of which, as shown clearly in FIG. 1, the second clamping ring 11 and the cowl 23 are interlocked in the manner of a bayonet fastening.

The cowl 23 has a cylindrical wall 24, in which the recesses 22 are provided and which engages over the annular disk 12. Arranged on the topside of the cowl 23 are handling eyes 25, by means of which the cowl 23 can be handled by a crane.

It can be seen from the illustration in FIG. 1 that, after the operation of filling the transportable vessel 1 has ended, the flexible filler hose 8 can be lowered into the vessel 1 through the filler socket 2 of the vessel, the length of penetration of the flexible filler hose 8 amounting to only half its total length. Consequently, the bottom end of the flexible filler hose 8 dipping below the level of liquid S marked in FIG. 1 terminates above the mixing paddle moved in the transportable vessel, so that mixing can even be carried out when the filler hose is retracted and the filler socket 2 is covered. Furthermore, because the flexible filler hose dips below the level of liquid S, only the liquid located within the cross-section of the filler hose is brought in breathing contact with the atmosphere outside the vessel, thus reducing the emissions considerably.

Reversing the flexible filler hose 8 ensures that, both in the stretched state during filling and in the reversed and immersed state during transport and mixing, only the inside of the filler hose comes in contact with the materials to be introduced, and consequently the filler hose remains clean on the outside and easy to handle even during repeated filling and immersing operations.

Because of the use of the flexible filler hose 8, differences in both vertical and lateral positioning of the filler socket 2 relative to the discharge orifice 18 can be compensated.

We claim:

1. A device for filling transportable vessels having filler sockets from containers holding flowable materials, the device comprising:

first clamping ring for coupling the device to the filler socket of the vessel;

a flexible circular filler hose fastened at a first end to the first clamping ring;

weighting ring having a diameter smaller than the inside diameter of the hose, the ring being placed outside the hose within a loop formed in said hose by folding the hose back upon itself, inside the hose and being capable of sliding up and down the hose when said hose is raised and lowered in said vessel; and second clamping ring for coupling the device to the containers, the second clamping ring being connected to a second end of the hose, after the hose has been folded back over itself to enclose the weighting ring and directed back through the first clamping ring, the second clamping ring being sized to fit over the first clamping ring when the device is in a stowed position in said vessel.

2. The device of claim 1, wherein the weighting ring is formed from a circular carrier element with a plurality of spherical ball bearings rotatably mounted thereon.

3. The device of claim 1 wherein the first clamping ring comprises an annular disk, on one side of which disk, around the inner circumference of the disk, a cylindrical connection piece has been mounted, the connection piece being directed toward the second clamping ring.

4. The device of claim 3 wherein the hose is fastened to the outside of the cylindrical connection piece by a clip and, after the hose has been folded back to enclose the weighting ring, it is directed through the cylindrical connection piece.

5. The device of claim 1 wherein the second clamping ring is comprised of an annular disk, upon one side of which disk a first cylindrical connection piece of inner diameter equal to the diameter of the central opening of the disk is mounted, the hose being directed through this first connection piece and fastened to it by means of a clip, and upon the other side of the disk a second cylindrical connection piece of inner diameter greater than that of the first connection piece and extending from the disk in the opposite direction is mounted.

6. The device of claim 5 wherein support bearings are arranged on the outside of the second cylindrical connection piece, the bearings being directed radially outward.

7. The device of claim 6 wherein the annular disk is equipped with holding lugs projecting beyond the outer periphery of the second cylindrical connection piece.

8. The device of claim 7 wherein a cowl with cylindrical walls, cover, and recesses along the bottom inner surface of the cylindrical walls is mounted over the second clamping ring, the recesses engaging with the holding lugs to form a removable bayonet fastening system for the cowl.

9. The device of claim 8, wherein handing eyes are mounted on the cover of the cowl.

* * * * *